United States Patent [19]

Herring et al.

[11] Patent Number: 5,073,992

[45] Date of Patent: Dec. 24, 1991

[54] LAVATORY ASSEMBLY

[75] Inventors: William P. Herring, Frome; Nicholas Rowland, Backwell, both of United Kingdom

[73] Assignee: Hornbeam Ivy Limited, United Kingdom

[21] Appl. No.: 554,669

[22] Filed: Jul. 19, 1990

[30] Foreign Application Priority Data

| | | | |
|---|---|---|---|
| Jul. 25, 1989 | [GB] | United Kingdom | 8916977 |
| Jan. 25, 1990 | [GB] | United Kingdom | 9001768 |
| Mar. 26, 1990 | [GB] | United Kingdom | 9006714 |

[51] Int. Cl.[5] ..... E03D 9/02

[52] U.S. Cl. ..... 4/227; 4/228

[58] Field of Search ..... 4/225, 227, 228; 222/384

[56] References Cited

U.S. PATENT DOCUMENTS

| | | | |
|---|---|---|---|
| 2,201,528 | 5/1940 | Freng | 4/225 X |
| 2,345,220 | 3/1944 | Sarchet | 4/227 X |
| 2,558,469 | 6/1951 | Travis | 4/228 |
| 3,999,226 | 12/1976 | Wolf | 4/228 X |
| 4,273,257 | 6/1981 | Smith et al. | 222/384 X |
| 4,312,082 | 1/1982 | Murphy et al. | 4/228 |
| 4,396,132 | 8/1983 | Christensen | 222/384 X |
| 4,872,222 | 10/1989 | Pavlik | 4/228 |

FOREIGN PATENT DOCUMENTS

| | | | |
|---|---|---|---|
| 189922 | 12/1922 | United Kingdom | 4/227 |
| 376995 | 7/1932 | United Kingdom | 4/228 |

*Primary Examiner*—Henry J. Recla
*Assistant Examiner*—Robert M. Fetsuga
*Attorney, Agent, or Firm*—Larson and Taylor

[57] ABSTRACT

A liquid dispenser is associated with a flush lavatory to enable disenfectant or liquid to be dispensed into the lavatory. The liquid dispenser has a reservoir, a pump and an outlet conduit. The liquid dispenser is preferably located in the cistern of the lavatory and liquid may be dispensed into the cistern or directly into the lavatory bowl. Normally, a part of the pump extends through the wall or lid of the cistern, and that part may be removable from a sleeve of the pump to enable the reservoir to be filled through that sleeve. A slot and a projection may be provided to cause the removable part to engage with the sleeve to prevent accidental removal.

8 Claims, 3 Drawing Sheets

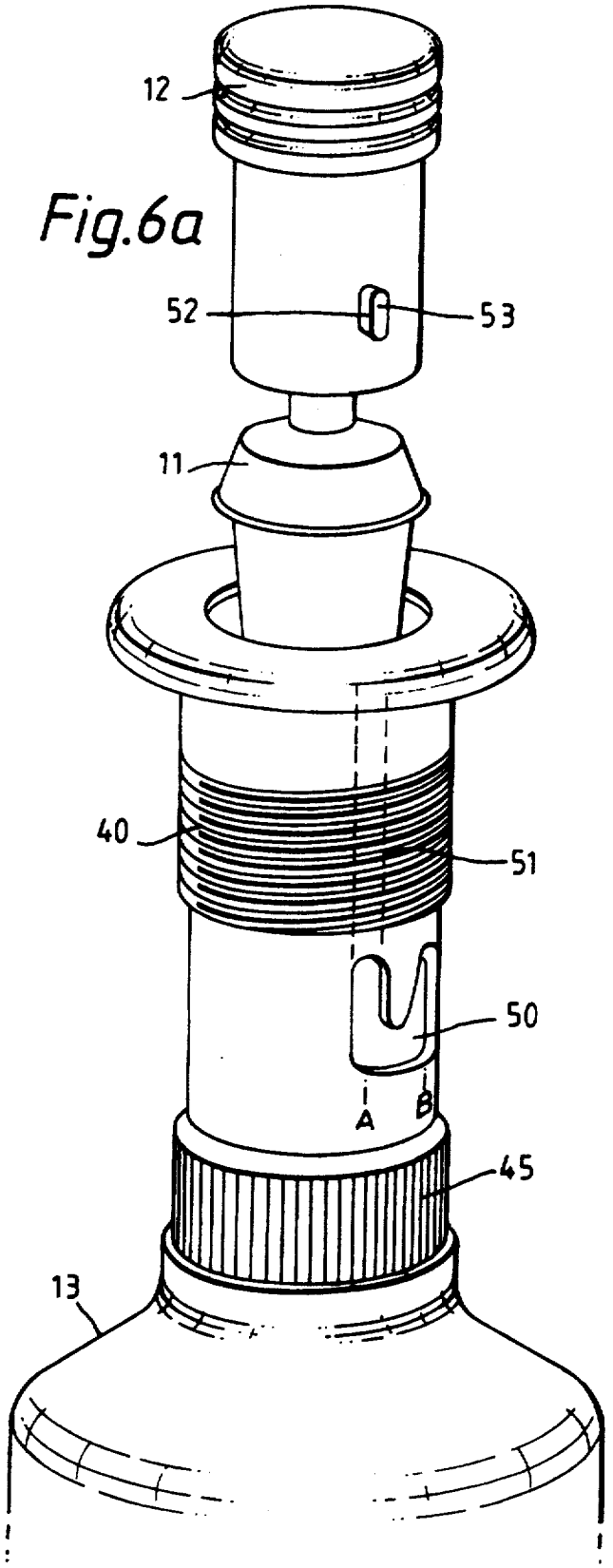
Fig.6a
Fig. 6b
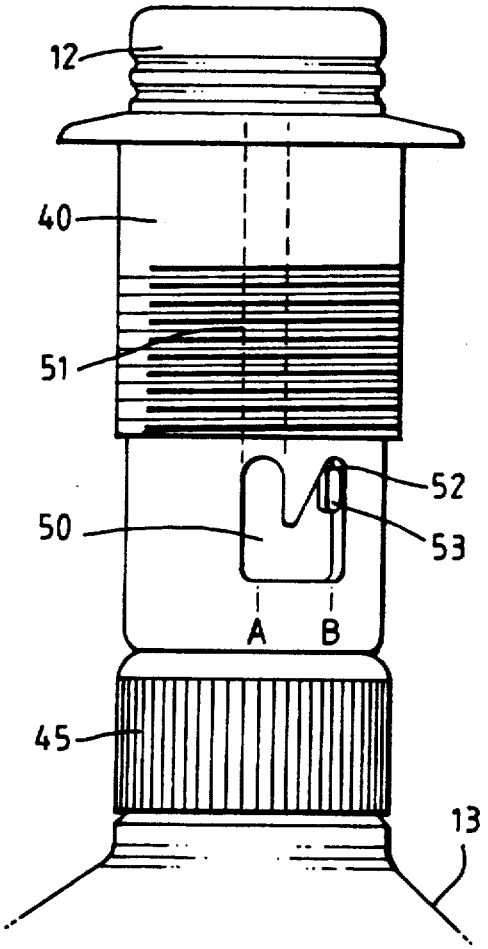

LAVATORY ASSEMBLY

BACKGROUND OF THE INVENTION

1. Field of the Invention

The present invention relates to a lavatory assembly having means for dispensing a disinfectant or other material.

2. Summary of the Prior Art

It is known to put in the cistern of a lavatory a block of solid disinfectant which slowly dissolves, so maintaining a concentration of disinfectant in the flushing water. It is also known to provide solid disinfectant in the bowl, suspended from the rim of the bowl, which partially dissolves on flushing to release disinfectant into the flushing water.

Solid disinfectant blocks have the problem that it is not possible to maintain a high concentration of disinfectant in the flushing water without the block of material dissolving quickly, and frequent replacement of the blocks is not convenient. In general, liquid disinfectants are more satisfactory than the solid blocks.

SUMMARY OF THE INVENTION

The present invention seeks to provide a convenient arrangement for enabling liquid disinfectant to be added to the flushing water, and to improve the distribution of disinfectant in a lavatory bowl, or in a urinal.

The present invention provides a lavatory assembly, being a flush lavatory comprising a cistern and a portion flushable by water from the cistern; and liquid dispensing means, the liquid dispensing means comprising actuating means for actuating the dispensing means, a reservoir inside the cistern for storing liquid to be dispensed and an outlet conduit through which the liquid is dispensed into the lavatory. In use the actuating means is actuated periodically to dispense liquid disinfectant from the reservoir into the lavatory, this being a convenient method of achieving a high and predetermined concentration of disinfectant in the lavatory.

The reservoir may be a bottle located within the cistern. Alternatively the reservoir may be integrally formed by a portion of the wall of the cistern.

The outlet conduit of the liquid dispensing means may be arranged to dispense liquid into the water in the lavatory cistern. Alternatively, the outlet may dispense the disinfectant directly to the flushed portion of the lavatory (e.g. a WC bowl). This has the advantage that undiluted liquid disinfectant may be dispensed where required.

In the latter case, the flushed portion may be a bowl having an inward turning lip at its rim, and a conduit extending at least partly around the bowl, the conduit being in communication with the liquid dispensing means. The conduit has apertures thereby to direct liquid from the liquid dispensing means under the lip.

In this way, disinfectant can be directed onto the surface under the lip which is difficult to reach in prior art lavatories.

The conduit may be defined by an insert of plastics material. Alternatively the enclosed channel may be defined by the bowl. Where the rim is totally enclosed apart from holes to let the water out, this is a particularly easy method of disinfecting. The reservoir of liquid in the conduit around the rim will ensure a more fragrant lavatory.

The lavatory may have an overflow pipe from the cistern to the bowl, in which case the outlet conduit from the liquid dispensing means may pass through the overflow pipe.

The actuating means is preferably mounted in a sleeve of the liquid dispensing means, which sleeve communicates with the resevoir. The actuating means may thus be removable from the sleeve to permit the resevoir to be refilled with the liquid to be dispensed. Preferably actuating means has an engagement part engaging the sleeve and permitting actuation of the actuating part during that engagement, with the actuating means retained on the sleeve, but that engagement being releasable to permit removal of the actuating means when desired.

In accordance with a further aspect thereof, the invention provides a combination of a liquid dispensing means, reservoir and outlet conduit adapted for insertion into and use in a lavatory assembly, the lavatory assembly including a flush lavatory comprising a flushed portion and a cistern, the combination, in use, dispensing liquid into the lavatory.

BRIEF DESCRIPTION OF THE DRAWINGS

Embodiments of the invention will now be described in greater detail by way of example of the present invention, with reference to the accompanying drawings in which:

FIGS. 6*a* and 6*b* show two views of part a further embodiment of the present invention.

DETAILED DESCRIPTION

Figure 1:
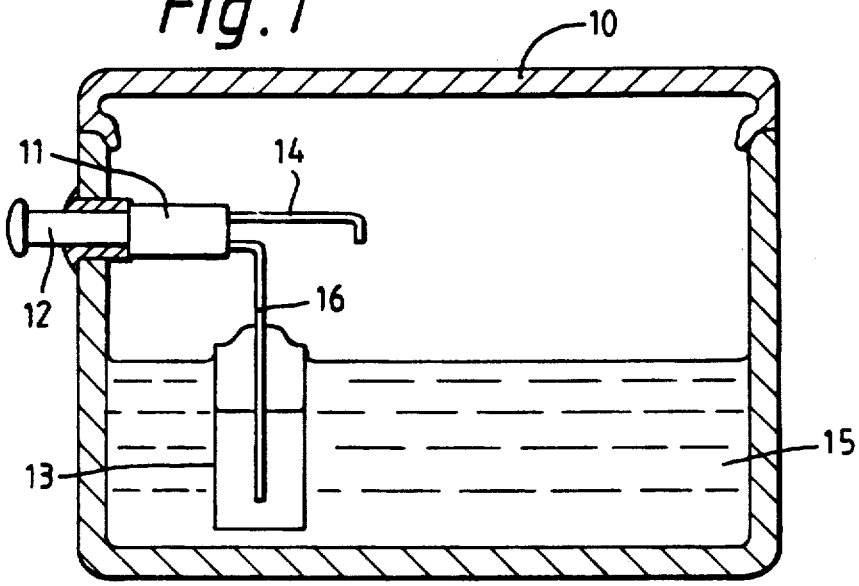
FIG. 1 shows a section through a cistern of a lavatory assembly which is a first embodiment to the invention.

FIG. 1 shows a cistern 10 which forms part of an embodiment of the invention. The flushing and refilling mechanism is not shown in the figure. In the cistern 10 is located a liquid dispenser consisting of a pump 11 coupled to a reservoir 13. The pump has an actuating rod 12 which passes through the wall of the cistern 10. The reservoir 13 is a plastics bottle 13 for holding liquid disinfectant. A pipe 16 leads from the reservoir 13 to the liquid pump 11. Manual depression of the actuating rod 12 actuates the pump 11 to pump disinfectant from the reservoir 13 through the outlet 14 of the pump which communicates with the interior of the cistern, into the flushing water 15. (The reservoir 13 may instead be incorporated into the wall of the cistern 10, for example it may be a pocket formed in the wall.)

Figure 2:
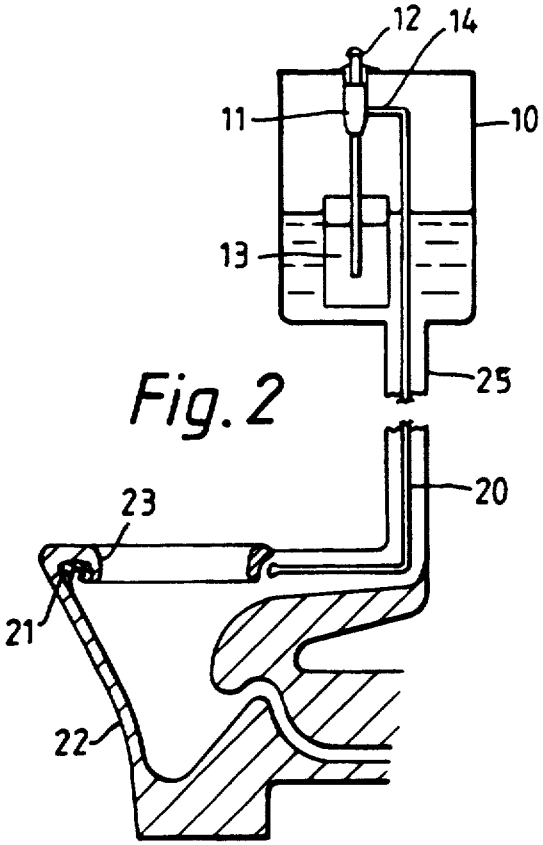
FIG. 2 shows a section through a lavatory assembly which is a second embodiment of the invention.

In FIG. 2, a second embodiment is shown which comprises a cistern 10, a bowl 22 and a liquid dispensing pump 11 with a reservoir bottle 13. The outlet 14 of the pump 11 is connected to a pipe 20. The pipe 20 connects the outlet with a conduit 21 under the lip 23 around the rim of the bowl 22. Apertures in the conduit 21 allow the liquid disinfectant to squirt onto the inner surfaces of the lip 23 when the pump 11 is actuated by an actuating button 12. In this embodiment the pipe 20 which connects the pump 11 with the bowl 22 is led inside the main delivery pipe 25 for the flushing water, though other means of communication are possible.

Figure 3:
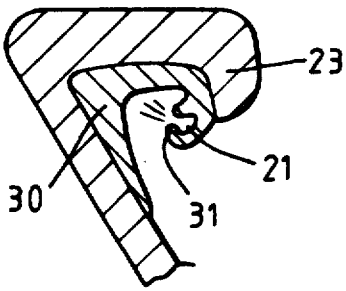
FIG. 3 shows a section through a lip of a bowl of a lavatory assembly which is an embodiment of the invention.
Figure 4:
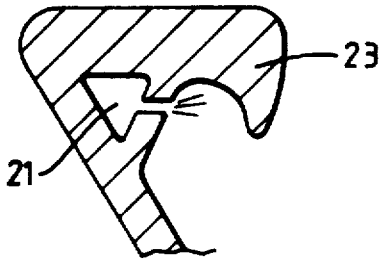
FIG. 4 shows a section through an alternative lip of a bowl of a lavatory assembly which is an embodiment of the invention.

FIGS. 3 and 4 show two alternative arrangements of conduit around the rim. FIG. 3 shows an insert 30 of plastics material which is adapted to fit snugly under the rim. It has a conduit 21 formed by moulding. Apertures 31 allow disinfectant to flow out of the conduit 21 and direct it upwards and outwards under the lip 23. The upward spray leaves a reservoir of fresh-smelling liquid around the rim, and the apertures 31 can be self-cleaning.

In FIG. 4, the conduit 21 is defined by the bowl itself, and in this case the flow is directed inwards and under the lip 23.

In both these arrangements, actuation of the liquid dispensing means causes undiluted disinfectant to be sprayed into the bowl under the lip. The disinfectant may then be flushed over all the bowl by subsequent flushing of the lavatory.

Figure 5:
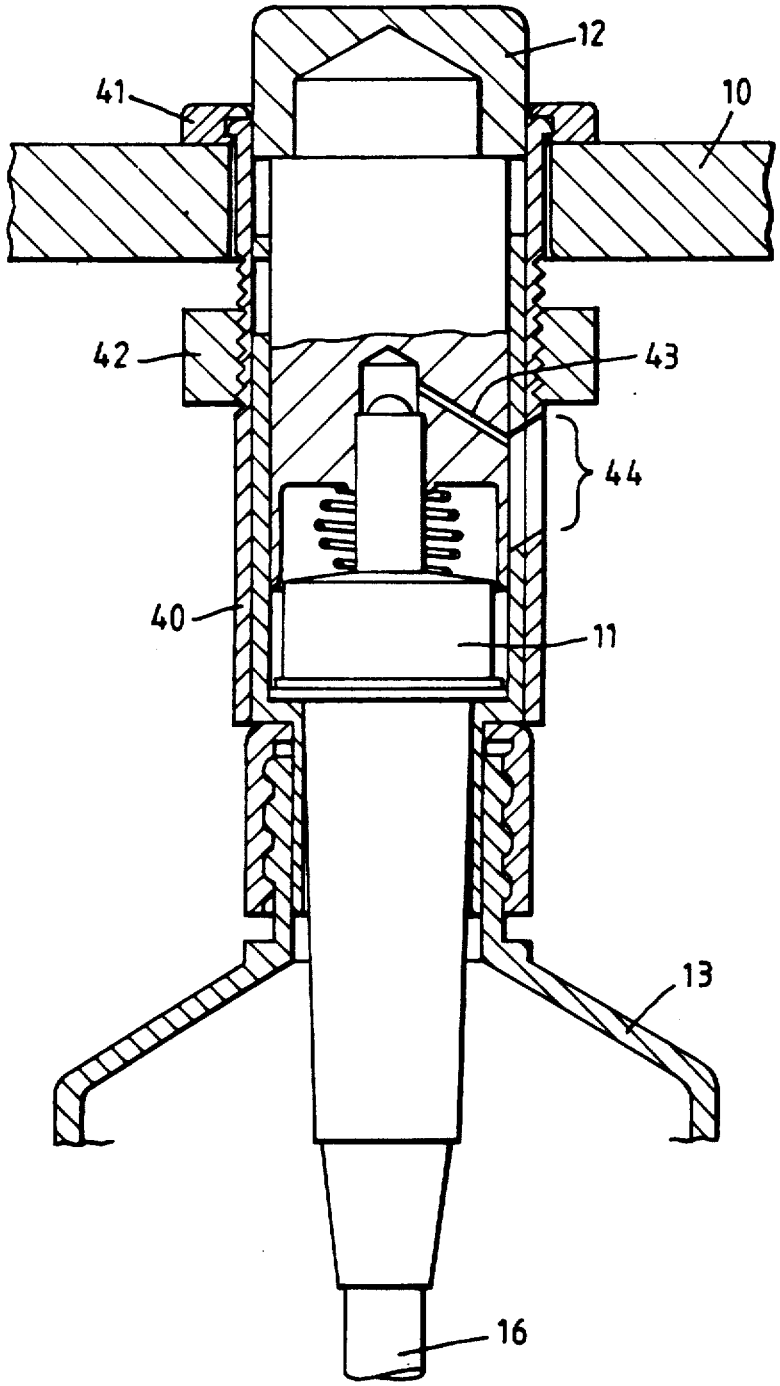
FIG. 5 shows a section through a part of a lavatory assembly being another embodiment of the present invention.

The embodiment of FIG. 5 is based on that of FIG. 1, in that the liquid dispenser is mounted in the cistern 10 and liquid is dispensed into the cistern 10, rather than into the bowl as in the second embodiment.

The important feature of this embodiment is that the liquid dispenser is mounted on the cover of the cistern 10, rather than in a side wall as in the embodiment of FIG. 1. Thus, FIG. 5 shows part of the cover of the cistern 10 (the rest of the cistern 10 being as in FIG. 1) with the liquid dispenser again comprising a pump 11 connected to an actuating rod 12 and to a reservoir in the form of a bottle 13 (only a part of which is shown) for holding liquid disinfectant. In the embodiment shown in FIG. 5, the pump 11 is housed in a sleeve 40 which has a flange 41 which holds the liquid dispenser in place on the cover of the cistern 10. The sleeve 40 communicates with the pipe 16 from the bottle 13. The dispenser may then be secured to the cover of the cistern 10 by a nut 42 on the sleeve 40. Depression of the actuating rod 12 actuates the pump 11 and disinfectant is pumped from the bottle 13 through the pipe 16 to an outlet duct 43 in the rod 12. That duct 43 is located adjacent a window 44 in the sleeve 40 so that disinfectant is pumped through the window 44 into the cistern. The length of the pipe 16 is reduced, compared to the first embodiment, and indeed that pipe 16 may be integral with the sleeve 40. Also shown in FIG. 5 is a nut 45 which retains the sleeve 40 on the bottle 13.

The advantage of the embodiment of FIG. 5 lies in the refilling of the bottle 13. With the embodiment of FIG. 1, the cover of the cistern 10 has to be removed in order to refill the bottle 13. In the embodiment of FIG. 5 (and also that of FIG. 2) a more simple method can be used. If the actuating rod 12 is pulled upwardly, it lifts the pump 12 out of the sleeve 40. The bottle 13 can then be refilled by pouring a suitable amount of disinfectant down the sleeve 40 into the bottle 13. The rod 11 and pump 12 can then be returned to the sleeve for continued dispensing of the disinfectant. This method of refill is particularly important for those cisterns which do not have a removable cover.

FIG. 6*a* and 6*b* show a further embodiment of the present invention. This embodiment is generally similar to that of FIG. 5 and the same reference numerals are used to indicate corresponding parts. The embodiment of FIGS. 6*a* and 6*b*, however has been designed to overcome a possible problem of the embodiment of FIG. 5. This problem is that if the pump 11 and rod 12 are readily removable from the sleeve 40, there is the risk that a child would remove the pump 11 and rod 12, and so get access to the material in the bottle, which may be poisonous. Therefore the embodiment of FIGS. 6*a* and 6*b* has a safety mechanism.

As can be seen in FIGS. 6*a* and 6*b*, the sleeve 40 has a U-shaped slot 50 therein, with that slot 50 having two arms A and B. The arm B is blind, but the arm A continues as a channel 51 in the inner surface of the sleeve 40, which channel 51 extends to the mouth of the sleeve 40 remote from the bottle 13. The rod 12 has a projection 52 thereon, which projection engages the slot 50 as shown at FIG. 6*b*.

In normal use, the projection 52 is received in arm B of slot 50.

Depression of the rod 12 moves the projection 52 in the arm B of the slot 50, so that the pump 11 may be actuated. It is not possible to withdraw the rod 12 and pump 11 from the sleeve 40 as the arm B of the slot 50 is blind. However, if the rod 12 is depressed and then turned, the projection 52 can then be aligned with arm A of slot 50. In this position, the rod 12 can be removed from the sleeve 40 as the projection can pass up the channel 51. Thus, the rod 12 has a "safe" position in which the pump 11 can be actuated with the rod 12 being retained in the sleeve 40, and a "removal" position in which the rod can be released from the sleeve 40.

FIGS. 6*a* and 6*b* show that the projection 52 may contain the duct 53 (corresponding to duct 43 in FIG. 5) for the outlet of liquid to be dispensed (in which case the slot 50 corresponds to the window 44). Alternatively the projection 52 and the outlet duct may be separate.

What is claimed is:

1. A lavatory assembly having, in combination;

a flush lavatory, said flush lavatory having a cistern and a part flushable from said cistern; and a liquid dispensing means connected to said flush lavatory for supplying liquid thereto, said liquid dispensing means comprising: a reservoir for liquid, said reservoir being in said cistern; an outlet conduit for dispensing said liquid therethrough from said reservoir into said flush lavatory; and actuating means for actuating the dispensing of liquid from said reservoir through said outlet conduit into said flush lavatory, said actuating means having a first part in the cistern and a second part extending out through an aperture in the cistern to thereby permit manual actuation thereof from outside of the cistern independently of the flushing of the lavatory.

2. A lavatory assembly according to claim 1, wherein said reservoir is a removable container.

3. A lavatory assembly according to claim 1 wherein said first part of said actuating means is a pump, and said second part of said actuating means being movable for actuating said dispensing means.

4. A lavatory assembly according to claim 3, wherein said cistern has a lid having said aperture therein and said second part of said actuating means extends through said aperture of said lid of said cistern.

5. A lavatory assembly according to claim 3 wherein said liquid dispensing means has a sleeve connected to said reservoir and to said outlet conduit, wherein said pump is located on said sleeve, and wherein said second part of said actuation means is removably mounted on said sleeve.

6. A lavatory assembly according to claim 5, wherein said second part of said actuation means has a first orientation within said sleeve in which it is restrained from removal from said sleeve and a second orientation in which it is removable from said sleeve.

7. A lavatory assembly according to claim 1, wherein said outlet conduit is arranged to dispense liquid therethrough directly into said cistern.

8. A lavatory assembly according to claim 1 wherein said outlet conduit is arranged to dispense liquid therethrough directly into said part flushable from said cistern.

* * * * *